United States Patent [19]

Kohyama

[11] 4,413,897

[45] Nov. 8, 1983

[54] ELECTROSTATIC COPYING APPARATUS

[75] Inventor: Mitsuaki Kohyama, Higashikurume, Japan

[73] Assignee: Tokyo Shibaura Denki Kabushiki Kaisha, Kawasaki, Japan

[21] Appl. No.: 202,174

[22] Filed: Oct. 29, 1980

[30] Foreign Application Priority Data

Oct. 31, 1979 [JP] Japan ..... 54-139763
Oct. 31, 1979 [JP] Japan ..... 54-139764

[51] Int. Cl.[3] ..... G03G 15/02

[52] U.S. Cl. ..... 355/3 CH; 250/324; 355/14 CH; 361/235

[58] Field of Search ..... 355/3 R, 3 TR, 3 CH, 355/14 TR, 14 CH; 250/324, 325, 326; 361/229, 235

[56] References Cited

U.S. PATENT DOCUMENTS

| | | | |
|---|---|---|---|
| 3,481,668 | 12/1969 | Roth et al. | 355/3 CH |
| 3,558,307 | 1/1971 | Carlson | 250/325 X |
| 3,744,898 | 7/1973 | Kurahashi et al. | 355/3 CH |
| 3,778,623 | 12/1973 | Sato et al. | 250/325 |
| 3,886,416 | 5/1975 | Gallo | 361/229 |
| 4,175,955 | 11/1979 | Seino et al. | 355/3 R X |
| 4,201,465 | 5/1980 | Oyama et al. | 355/3 CH X |
| 4,288,514 | 9/1981 | Kutsuwada et al. | 355/14 CH X |

FOREIGN PATENT DOCUMENTS

| | | | |
|---|---|---|---|
| 53-148444 | 12/1978 | Japan . | |
| 54-11735 | 1/1979 | Japan . | |
| 55-60968 | 5/1980 | Japan | 355/14 CH |

*Primary Examiner*—Fred L. Braun
*Attorney, Agent, or Firm*—Cushman, Darby & Cushman

[57] ABSTRACT

An arrangement for removing charges trapped in the photoconductive material of an electrostatic copier. The arrangement includes a light-emitting unit for supplying the photoconductive material with light having a long wavelength to render the photoconductive layer non-conducting. Energy supplied in this long wavelength causes electric charges trapped in the photoconductive layer to be released in the presence of an electric field generated between the photoconductive layer and its conductive support member.

10 Claims, 5 Drawing Figures

ELECTROSTATIC COPYING APPARATUS

BACKGROUND OF THE INVENTION

This invention relates to an electrostatic copying apparatus and more particularly to an electrostatic copying apparatus provided with a photosensitive layer whose light-irradiated portion is rendered conducting.

An electrostatic copying apparatus generally comprises a photosensitive drum which is formed of a drum body acting as a conductive support, and a photosensitive layer prepared from a photoconductive material and mounted on the outer peripheral wall of the drum body. The photoconductive material includes, for example, amorphous selenium, zinc oxide, cadmium sulfide, anthracene, polyvinyl carbazole, and those of the above-listed materials which are further mixed with a sensitizer. The electrostatic characteristic of the photosensitive layer varies with the kind of a raw photoconductive material or the method of manufacturing the raw photoconductive material.

The photosensitive layer is subjected to a copying cycle including electrification, exposure of an image to light, development, transcription, cleaning and discharge, all these steps being carried out in the order mentioned. An electrifying device electrifies the photosensitive layer to render it photosensitive. The electrification of the photosensitive layer by the electrifying device is carried out by exposing the photosensitive layer to a corona discharge and depositing the resultant ions on the surface of the photosensitive layer. The corona discharge is effected by impressing a voltage of several thousand volts on a space defined between a fine conductor stretched immediately above the photosensitive layer and the drum body. At this time, a corona emitted from the conductor ionizes the molecules of the surrounding air to produce ions. The photosensitive layer is electrified by the deposition of ions to have a predetermined surface potential.

The light source, for example a lamp, of the discharge device irradiates light beams and specified portion of the photosensitive layer for electric conduction. The discharge device releases electric energy charged on the specified portion by the following way. The electrons of a photoconductive material constituting the photosensitive layer are excited when absorbing light beams having a prescribed wavelength. A larger number of free carriers formed of free electrons and free holes are produced in the above-mentioned excitation than in the thermal equilibrium, rendering the photosensitive layer conducting. As a result, the photosensitive layer can no longer hold electric energy on the surface. In other words, electric energy passes along with the free carriers through the specified portion of the photosensitive layer which is now rendered conducting. Consequently, the photosensitive layer is discharged by being earthed through the drum body acting as a conductive support.

Where, however, the photosensitive layer is repeatedly electrified and discharged, then electric energy which is not completely released by the discharge is trapped or retained in the photosensitive layer. In other words, the so-called fatigue appears in the photosensitive layer. This means that as shown by curve (a) in FIG. 1, repeated copying operations give rise to an increase in the residual potential of the photosensitive layer due to the trapping of electric energy. Now let it be assumed one copying cycle takes 2.5 seconds with respect to a photosensitive layer whose photoconductive material is prepared from a seleniumtellurium alloy. Then, it has been experimentally found that trapped electric energy begins to be brought to a saturated condition at about the 100th copying cycle, the residual surface potential of the photosensitive layer reaching about 150 volts. As a result, a difference between the increased residual surface potential and development bias voltage as shown by curve (b) is prominently reduced as seen from curves (a) and (b) shown in FIG. 1. Thus, the fatigue of the photosensitive layer appears in the form of fogging on the white ground of an image transcribed on a copy sheet, resulting in a decline in the picture quality.

The trapped electric energy adversely affects the surface potential of the electrified photosensitive layer. In other words, the surface potential decreases, as seen from curve (c) shown in FIG. 1, from that which is produced when the copying operation is commenced by an amount corresponding to that of the trapped electric energy which is thermally released. Where a sample photosensitive layer was repeatedly electrified and discharged with the initial surface potential chosen to be 800 volts, then the initial surface potential of 800 volts fell to about 700 volts at about the 50th copying cycle as seen from FIG. 1 due to the saturated condition of the trapped electric energy. Accordingly, the fatigue of the photosensitive layer appeared in the form of a decline in the concentration of a transcribed image, that is, the picture quality.

Where, however, the deteriorated photosensitive layer is stored in the dark place during long time, then electric energy trapped in the photosensitive layer is gradually released by thermal energy resulting from the natural ambient temperature, thereby bringing the photosensitive layer to the original condition. Nevertheless, with an automatic electrostatic copying apparatus whose photosensitive layer is repeatedly electrified and discharged at a high speed, the photosensitive layer is continuously subject to fatigue. With a high speed electrostatic copying apparatus, wherein the photosensitive layer is normally allowed to have an extremely short rest time, the remaining fatigue of the photosensitive layer exerts a prominently adverse effect. In other words, the deterioration of the photosensitive layer presents great difficulties in ensuring the speedy and efficient operation of an electrostatic copying apparatus.

Hitherto, no decidedly effective resolution has been proposed with regard to the above-mentioned problems. Proposals of resolution advanced to date are intended only to control a voltage impressed on an electrifying device in accordance with changes in the surface potential of a photosensitive layer or an amount of light beams which are irradiated to provide a latent image. An electrostatic copying apparatus set forth in, for example, the recent Japanese patent disclosure No. 148,444 (1978) is intended to effect improvements on the copying process. The object of this patent disclosure is to irradiate light beams on a photosensitive layer immediately before its electrification particularly to suppress changes in the static characteristic of the photosensitive layer when repeatedly electrified and discharged at a high speed. With the above-mentioned patent disclosure, a decline in the picture quality of an image transcribed on a copy sheet is indeed reduced to an appreciably satisfactory extent. But an electrostatic copying apparatus embodying that patent disclosure would extremely increase in cost if practically constructed. Proposals advanced to date regarding an electrostatic copying apparatus may be considered to have achieved a noteworthy improvement, if cost is neglected. Yet viewed from a fundamental patent object of making a noteworthy contribution to industrial development, any new technique, if involving a high manufacturing cost, can hardly be regarded as a truthful improvement on the prior art.

SUMMARY OF THE INVENTION

This invention has been accomplished in view of the above-mentioned circumstances, and is intended to provide an electrostatic copying apparatus wherein changes in the static characteristic of a photosensitive layer resulting from its fatigue are reliably prevented at a low cost; and the appearance of fogging on an image transcribed on a copy sheet and a decrease in the concentration of the image are suppressed, thereby providing an excellent picture quality.

According to an aspect of the present invention, there is provided an electrostatic copying apparatus which comprises:

- a photosensitive layer prepared from a photoconductive material;
- a support member built of an electrically conductive material to hold the photosensitive layer;
- a light-emitting means for supplying the photosensitive layer with a light which has a prescribed wavelength, renders the photosensitive layer insulated, and sends forth energy to release electric energy trapped in the photosensitive layer; and
- voltage-impressing means for generating a potential difference between the photosensitive layer and its conductive support member, and expelling electric energy released by irradiation of light beams to the conductive support member of the photosensitive layer.

DETAILED DESCRIPTION OF THE PREFERRED EMBODIMENT

Figure 1:
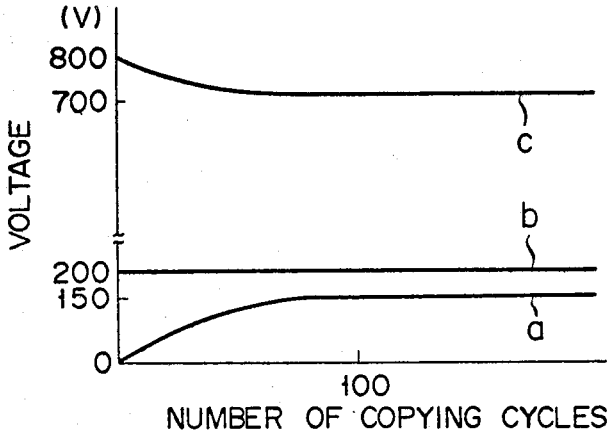
FIG. 1 (PRIOR ART)
FIG. 1 is a curve diagram showing changes in the static characteristic of the prior art photosensitive layer.
Figure 2:
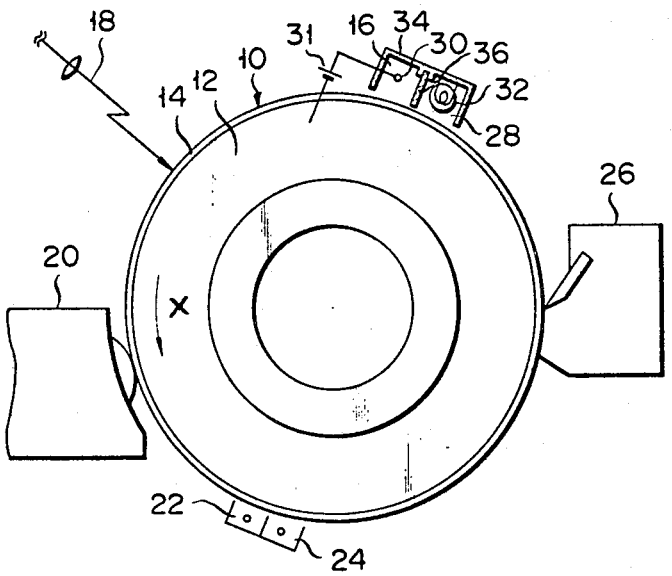
FIG. 2 is a schematic sectional view of an electrostatic copying apparatus embodying this invention.
Figure 3:
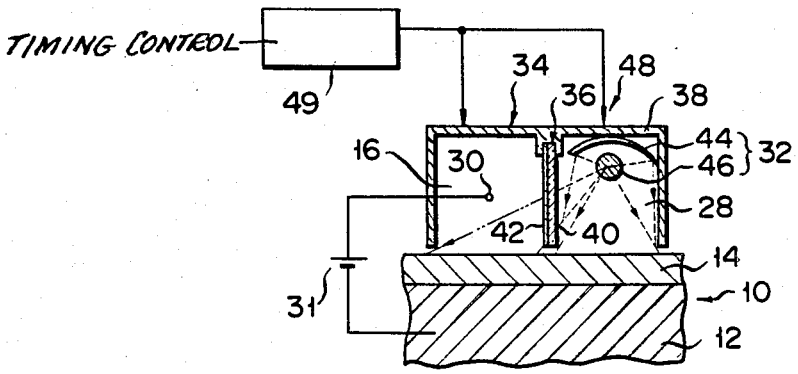
FIG. 3 is a schematic sectional view of a trapped electric energy-releasing device for releasing trapped electric energy.

Description is now given with reference to the accompanying FIGS. 2 and 3 an electrostatic copying apparatus embodying this invention.

As shown in FIG. 2, a photosensitive drum 10 is rotatably set in an electrostatic copying apparatus to be connected to a drive mechanism (not shown). The photosensitive drum 10 comprises a drum body 12 acting as a conductive support member and a photosensitive layer 14 prepared from a photoconductive material (in this embodiment, a selenium-tellurium alloy) and mounted over the outer peripheral wall of the drum body 12. The photosensitive drum 10 is rotated counterclockwise of FIG. 2 as indicated by an arrow x for a prescribed length of time.

Provided around the photosensitive drum 10 are:

- an electrifying device 16 for electrifying the photosensitive layer 14 to render it photoconductive;
- an optical device 18 for emitting light beams on the photosensitive layer 14 to produce thereon a static latent image the same as an impression on an original sheet (not shown);
- a developing device 20 for developing the static latent image by a toner;
- a transcription device 22 for transcribing a developed image on a copy sheet;
- a peeling device 24 for removing a copy sheet on which a toner image has been transcribed from the surface of the photosensitive drum 10;
- a cleaning device 26 for taking off a toner remaining on the surface of the photosensitive layer 14; and
- a discharge device 28 for expelling electric energy charged on the surface of the photosensitive layer 14. All the above-mentioned members are arranged in the direction of the arrow x in the order mentioned.

The electrifying device 16 is a formed of a corona discharge unit, and the discharge device 28 is constituted by a light-emitting unit. The corona discharge unit 16 comprises a fine corona conductor 30 and a power source 31 for impressing a voltage on a space defined between the corona conductor 30 and drum body 12. The light-emitting unit 28 comprises a light source 32. The corona discharge unit 16 and light-emitting unit 28 are set in the same casing 34 close to each other with the later described optical filter 36 interposed therebetween.

The casing 34 is open on one side as shown in FIG. 3. The lower plane of the opening faces the photosensitive layer 14 at a prescribed distance. The casing 34 extends in the axial direction of the photosensitive drum 10.

An optical filter 36 vertically extends downward toward the photosensitive layer 14 from the underside of an upper board 38 of the casing 34 defining the upper plane of the opening. The optical filter 36 comprises a transparent support plate 40 (a glass plate in this embodiment), and a thin layer 42 prepared from the same photoconductive selenium-tellurium alloy as that which constitutes the photosensitive layer 14. This thin alloy layer 42 is spread over the glass plate 40 by vacuum deposition to a thickness of about 1 micron. The corona discharge unit 16 is set in the left side chamber of the casing 34 defined by the optical filter 36. The light-emitting unit 28 is disposed in the right side chamber of the casing 34 defined by the optical filter 30.

The light source 32 of the light-emitting unit 28 comprises a reflector 44 set close to the upper board 38 of the right side chamber of the casing 34 and a lamp 46 positioned on that side of the reflector 44 which faces the photosensitive layer 14. Light beams emitted from the lamp 46 are conducted toward the photosensitive layer 14 by the reflector 44. The lamp 46 is designed to send forth light beams having a flat wavelength characteristic.

The corona discharge unit 16 acting as an electrifying device and the light-emitting unit 28 acting as a discharge device comprise in common the optical filter 36, power source 31 and timing control circuit 49. The timing control circuit 49 is connected to the corona discharge unit 16 and light-emitting unit 28, and controlling the timing of commencement of both units' actuation. Both corona discharge unit 16 and light-emitting unit 28 jointly constitute a trapped electric energy-releasing device 48.

Description is now given of the operation of an electrostatic copying apparatus embodying this invention which is arranged as described above.

When the copying operation starts, the photosensitive drum 10 is rotated counterclockwise in the direction of the arrow x. At this time, high voltage is impressed on the corona wire 30 of the corona discharge unit 16, which in turn generates a corona. The corona ionizes the molecules of the surrounding air. Ions are deposited over that portion of the surface of the photosensitive layer 14 which faces the opening of the casing 34. This surface portion of the photosensitive layer 14 is hereinafter referred to as "a corona discharge region".

Where the photosensitive drum 10 is rotated, the lamp 46 of the light-emitting unit or discharge device 28 is operated to emit light beams when the electrifying device 16 is started by the timing control circuit 49. The light beams are irradiated on that portion of the surface of the photosensitive layer 14 which faces the opening of the casing 34 directly or after sent back by the reflector 44. This surface portion of the photosensitive layer 14 is hereinafter referred to as "a light-irradiated region". With the foregoing embodiment, the corona discharge region and light-irradiated region are actually the same.

The light-irradiated region is divided into a first light-irradiated section which faces the lower plane of the opening of the right side chamber of the casing 34 and a second light-irradiated section which faces the lower plane of the opening of the left side chamber of the casing 34. As seen from FIG. 3, light beams directly emitted from the lamp 46, namely, those having a flat wavelength characteristic are conducted to the first light-irradiated region. Light beams passing through the optical filter 36 are irradiated on the second light-irradiated region. The thin layer 42 used with the optical filter 36 is prepared from the same photoconductive material as that which constitutes the photosensitive layer 14. Light beams conducted through the optical filter 36 are changed into light beams in which a particular wavelength region associated with the formation of free carriers in the photosensitive layer 14 is cut off by the thin layer 42, namely, into light beams having a long wavelength.

Free carriers are formed in the first light-irradiated region (though regarded as a corona discharge region) by emission of light beams having a wavelength of a particular region from the lamp 46. As a result, the first light-irradiated region is rendered conducting, and can no longer hold electric energy resulting from the corona discharge on the surface. In other words, discharge of electric energy is carried out in the first light-irradiated region.

Free carriers are not formed in the second light-irradiated region acting as the corona discharge region, depending on the wavelength of light beams transmitted through the optical filter 36. Therefore, the second light-irradiated region is rendered nonconducting. Accordingly, electric energy resulting from a corona discharge is retained on the surface of the photosensitive layer 14. In other words, electrification is carried out in the second light-irradiated region. In the second light-irradiated region, light beams of long wavelength which have passed through the optical filter 36 are conducted to the electric energy trapped in the photosensitive layer 14. When absorbing the light beams of long wavelength, the trapped electric energy increases in energy level, and is rendered more releasable. When released, the trapped electric energy is quickly expelled from the photosensitive layer 14 to the conductive drum body 14 by a strong electric field generated by high voltage impressed between the corona wire 30 and drum body 12. Once released by light beams of great wavelength, therefore, tapped electric energy is little likely to be trapped again in the photosensitive layer 14.

With an electrostatic copying apparatus embodying this invention, electric energy trapped in the photosensitive layer 14 while it is electrified can be effectively released and expelled as described above. Later, a static latent image is formed on the surface of the photosensitive layer 14 by means of the optical device 18. The latent image is developed by a toner in the developing device 20. A toner-developed image on the photosensitive layer 14 is transferred on the surface of a separately supplied copy sheet (not shown) in the transcription device 22. The copy sheet bearing the transcribed image is taken off the photosensitive layer 14 by the peeling device 24, and then conducted to a fixing device (not shown), where the toner-developed image is fixed to provide a fully copied image.

A toner remaining on the surface of the photosensitive layer 14 from which a toner-developed image has been transcribed is removed by the cleaning device 26. The above-mentioned steps complete a copying cycle.

According to this invention, light beams of long wavelength capable of suppressing the formation of free carriers in the photosensitive layer 14 are irradiated on the photosensitive layer 14 when it is electrified at the commencement of the copying operation. This process allows for the easy release of electric energy trapped in the photosensitive layer 14 due to its deterioration. After being released, the trapped electric energy is quickly expelled from the photosensitive layer 14 by a strong electric field produced by the electrifying device 16 at this time. Once released, therefore, the trapped electric energy is little likely to be trapped again in the photosensitive layer 14. In other words, even when the copying cycle is repeated, no increase takes place in an amount of electric energy trapped in the photosensitive layer 14. Consequently, it is possible to suppress easily and at low cost a decline in the static characteristic of the photosensitive layer 14, that is, an increase in the residual potential of the layer due to its fatigue, and a decrease in its surface potential, thereby providing a distinct impression on a copy sheet with a stabilized picture quality.

With the prior art electrostatic copying apparatus, the static characteristic of the photosensitive layer was deteriorated even at room temperature or low ambient temperature as 5° to 10° C. In contrast, the above-mentioned advantageous effect of an electrostatic copying apparatus embodying this invention is always ensured regardless of the ambient temperature.

It has been disclosed in various forms of literature that irradiation of light beams having a long wavelength is effective to release electric energy trapped in a photosensitive layer. A known electrostatic copying apparatus in which the irradiation of light beams of long wavelength is tried for practical application includes the type set forth in the patent disclosure No. 148,444 (1978) in which light beams having a long wavelength are irradiated on a photosensitive layer immediately before it is electrified. According to this patent disclosure, irradiation of light beams of long wavelength can indeed release electric energy trapped in a photosensitive layer. But only a low electric field is generated in the photosensitive layer when irradiated by light beams of long wavelength. After released, therefore, the trapped energy is not quickly expelled from the photosensitive layer, but is very likely to be trapped again therein. Consequently, the electrostatic copying apparatus of the aforesaid patent disclosure No. 148,444 (1978) is too inefficient to satisfactorily resolve difficulties still encountered in the field of an electrostatic copying apparatus.

In this connection, reference is made to a proposal already advanced, in which irradiation of light beams of long wavelength is tried for practical application. According to this proposal, light beams of long wavelength are irradiated on a photosensitive layer at the generation of an A.C. corona, while electric energy trapped in the surface of the photosensitive layer is released. In this case, however, new free carriers are produced in the photosensitive layer. As a result, the surface electric energy of the photosensitive layer transported by the free carriers are successively trapped in the photosensitive layer. Eventually, electric energy trapped in the photosensitive layer are driven into the too deep regions thereof for release. The above-mentioned second proposal causes electric energy trapped in the photosensitive layer to be rather increased, and can not be regarded at all as a proper solution of difficulties now under discussion.

It will be noted that the electrostatic copying apparatus of this invention is not limited to the foregoing embodiment, but may be applied in various modifications. For instance, an amount of light beams sent forth from the light source 32 of the light-emitting unit 28, or a wavelength characteristic of the light beams can be selected in accordance with the static characteristic of any of the various photoconductive materials used to provide the photosensitive layer 14. Further, the static characteristic of the photosensitive layer can be more effectively controlled and more reliably stabilized in accordance the property of the photosensitive layer which causes electric energy to be trapped noticeably or to a relatively negligible extent, or regulating an amount of light beams emitted from the light source 32 in accordance with the frequency with which the copying cycle is repeated, that is, increasing the amount of light beams according as the copying cycle is continued more often. A particular extreme case may be cited in this connection where a photosensitive layer which raised problems in connection with changes in the surface potential had its static property stabilized simply by being exposed to light beams of long wavelength only during the initial several copying cycles.

Figure 4:
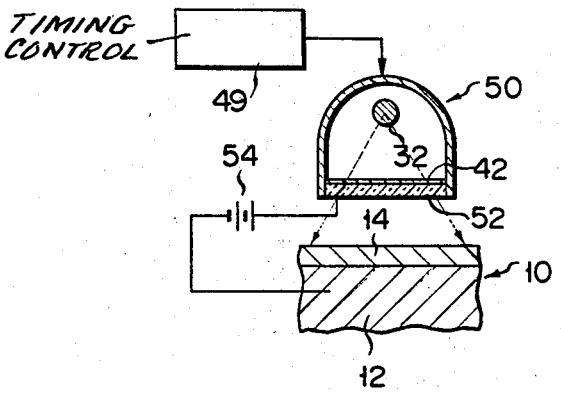
FIG. 4 is a schematic sectional view of a first modification of the trapped electric energy-releasing device of FIG. 3.

Further where light beams capable of suppressing the formation of free carriers are irradiated on the photosensitive layer 14 to which a strong electric field is already applied, then electric energy trapped in the photosensitive layer 14 can be effectively released. Therefore, a trapped electric energy-releasing device 50 may be formed by arranging, as shown in FIG. 4, a transparent electrode 52 facing a prescribed portion of the surface of the photosensitive layer 14; a thin layer 42 prepared from the same photoconductive material as that which constitutes the photosensitive layer 14; a power source 54 for impressing a prescribed voltage between the transparent electrode 52 and drum body 12; a light source 32 for irradiating light beams on a prescribed portion of the surface of the photosensitive layer 14 through a thin layer 42 all between the electrifying device 16 and optical device 18; and the timing control circuit 49 for controlling the timing in which the light source 32 is operated. In the case of FIG. 4, the electrifying device 16 cannot concurrently act as the discharge device 28. Therefore, both electrifying device 16 and discharge device 28 have to be separately provided. The point of time at which the light source 32 is started is controlled by the timing control circuit 49 after the actuation of the electrifying device 16 and before that of the optical device 18.

Figure 5:
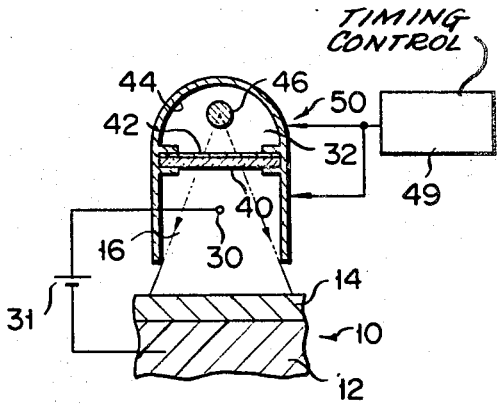
FIG. 5 is a schematic sectional view of a second modification of the trapped electric energy-releasing device of FIG. 3.

It is possible, as seen from FIG. 5, to set the above-mentioned trapped electric energy-releasing device 50 above the electrifying device 16 for electrifying a prescribed portion of the surface of the photosensitive layer 14. This arrangement makes it possible to omit the power source 15 from the trapped electric energy-releasing device 50, thereby simplifying the arrangement of an electrostatic copying apparatus.

Throughout all the above-mentioned cases, the thin layer 42 of the optical filter 36 was prepared from the same photoconductive material as that which constitutes the photosensitive layer 14. However, this invention is not limited to this arrangement. Any optical filter well serves the purpose if it provides light beams capable of suppressing the formation of free carriers in the photosensitive layer 14. For example, it is possible to apply any of Toshiba glass filters V-68, V-69 and IR-DIB.

What is claimed is:

1. An electrostatic copying apparatus comprising:

a support member being formed of an electrically conductive material;

a photosensitive layer deposited on said support member, said photosensitive layer being formed of a photoconductive material which is photosensitive to light having wavelengths falling within a first predetermined range and is not photosensitive to light having wavelengths falling within a second predetermined range; and means for removing charges trapped in the photosensitive layer, including means for irradiating said photosensitive layer with light having a wavelength in said second range for causing the release of charges trapped in said photosensitive layer and means for generating, simultaneously with the said second range wavelength irradiation, an electric field for expelling released charges from said photosensitive layer to said support member.

2. An electrostatic copying apparatus according to claim 1, wherein said irradiating means comprises:

light source means for emitting light having wavelengths falling within at least said first and second ranges, and optical filter means, disposed between said light source means and said photosensitive layer for absorbing light rays of said first range wavelength and transmitting only light rays of said second range wavelength.

3. An electrostatic copying apparatus according to claim 2, wherein said optical filter means comprises a transparent substrate, and a thin film formed of a photoconductive material disposed on said substrate.

4. An electrostatic copying apparatus according to claim 2, wherein said photosensitive layer is arranged with respect to said charge removing means so that a first portion of said layer is directly irradiated with the light emitted from said light source means, and a second portion of said layer is irradiated with the light emitted from said light source means and transmitted via said optical filter means, and wherein said electric field generating means comprises means for generating said electric field in said second portion of said photosensitive layer.

5. An electrostatic copying apparatus according to claim 4, further comprising means for discharging said photosensitive layer, and means for charging said photosensitive layer after it has been discharged by said discharging means, and wherein said means for removing the charges trapped in the photosensitive layer is disposed so as to operate in time between the discharging occurring by operation of said discharging means and the charging occurring by operation of said charging means.

6. An electrostatic copying apparatus according to claim 5, wherein said discharging means is formed by said light source means emitting light including light of said first wavelength range.

7. An electrostatic copying apparatus according to claim 6, wherein said charges removing means and discharging means are formed as a unitized unit and wherein said photosensitive layer is discharged at its first portion thereof.

8. An electrostatic copying apparatus according to claim 5, wherein said charging means comprises a corona charger including a conductive wire disposed above said photosensitive layer, and means for applying a predetermined voltage between said conductive wire and said support member.

9. An electrostatic copying apparatus according to claim 8, wherein the voltage applying means includes said electric field generating means.

10. An electrostatic copying apparatus according to claim 9, wherein said voltage applying means is disposed so as to face said second portion of the photosensitive layer and charges said second portion.

* * * * *